US006723669B1

(12) United States Patent
Clark et al.

(10) Patent No.: US 6,723,669 B1
(45) Date of Patent: Apr. 20, 2004

(54) FINE MULTICOMPONENT FIBER WEBS AND LAMINATES THEREOF

(75) Inventors: Darryl Franklin Clark, Alpharetta, GA (US); Justin Max Duellman, Little Rock, AR (US); Bryan David Haynes, Cumming, GA (US); Matthew Boyd Lake, Cumming, GA (US); Jeffrey Lawrence McManus, Canton, GA (US); Kevin Edward Smith, Knoxville, TN (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/465,298

(22) Filed: Dec. 17, 1999

(51) Int. Cl.[7] ..... B32B 5/26; D04H 1/56; D04H 3/16

(52) U.S. Cl. ..... 442/347; 442/329; 442/340; 442/345; 442/350; 442/351; 442/361; 442/382; 442/389; 442/401; 442/409; 442/411

(58) Field of Search ..... 442/329, 340, 442/345, 346, 347, 350, 351, 361, 381, 382, 389, 400, 401, 409, 411

(56) References Cited

U.S. PATENT DOCUMENTS

| | | | | |
|---|---|---|---|---|
| 3,425,091 A | | 2/1969 | Ueda et al. | 18/8 |
| 3,692,618 A | | 9/1972 | Dorschner et al. | 161/72 |
| 3,802,817 A | | 4/1974 | Matsuki et al. | 57/164 |
| 3,849,241 A | | 11/1974 | Butin et al. | 161/169 |
| 3,900,678 A | * | 8/1975 | Aishima et al. | 428/374 |
| 3,981,650 A | | 9/1976 | Page | 425/72 |
| 4,041,203 A | | 8/1977 | Brock et al. | 428/157 |
| 4,340,563 A | | 7/1982 | Appel et al. | 264/518 |
| 4,526,733 A | | 7/1985 | Lau | 264/12 |
| 4,547,420 A | | 10/1985 | Krueger et al. | 428/229 |
| 4,729,371 A | | 3/1988 | Krueger et al. | 128/206.19 |

(List continued on next page.)

FOREIGN PATENT DOCUMENTS

| | | |
|---|---|---|
| EP | 0 466 381 | 1/1992 |
| EP | 0 561 612 | 9/1993 |
| EP | 0 754 796 | 1/1997 |
| EP | 0 729 375 | 4/1999 |
| WO | 96/13319 | 5/1996 |
| WO | 97 34037 A | 9/1997 |
| WO | 99/32692 | 7/1999 |

OTHER PUBLICATIONS

Abstract of JP 07–003595 dated Jan. 6, 1995.
"Enhanced Barrier Performance of Bicomponent Fiber Meltblown Nonwovens" by Larry C. Wadsworth et al., Nonwovens World, Aug.–Sep. 1999, pp. 40–46.
"New Products from Bicomponents" by Arnold E. Wilkie, Hill's Inc.

*Primary Examiner*—Cheryl J. Juska
*Assistant Examiner*—Jenna-Leigh Befumo
(74) *Attorney, Agent, or Firm*—Douglas H. Tulley; Robert A. Ambrose

(57) ABSTRACT

The present invention provides multicomponent fine fiber webs and multilayer laminates thereof having an average fiber diameter less than about 7 micrometers and comprising a first olefin polymer component and a second distinct polymer component such as an amorphous polyolefin or polyamide. Multilayer laminates incorporating the fine multicomponent fiber webs are also provided such as, for example, spunbond/meltblown/spunbond laminates or spunbond/meltblown/meltblown/spunbond laminates. The fine multicomponent fiber webs and laminates thereof provide laminates having excellent softness, peel strength and/or controlled permeability.

8 Claims, 6 Drawing Sheets

U.S. PATENT DOCUMENTS

| | | | | | |
|---|---|---|---|---|---|
| 4,766,029 | A | | 8/1988 | Brock et al. | |
| 4,795,668 | A | | 1/1989 | Krueger et al. | 428/174 |
| 4,824,451 | A | | 4/1989 | Vogt et al. | 55/528 |
| 5,141,699 | A | | 8/1992 | Meyer et al. | |
| 5,160,746 | A | | 11/1992 | Dodge, II et al. | 425/7 |
| 5,162,074 | A | | 11/1992 | Hills | 156/644 |
| 5,176,952 | A | | 1/1993 | Joseph et al. | 428/284 |
| 5,204,174 | A | | 4/1993 | Daponte et al. | 428/286 |
| 5,207,970 | A | | 5/1993 | Joseph et al. | 264/518 |
| 5,232,770 | A | | 8/1993 | Joseph | 428/284 |
| 5,238,733 | A | | 8/1993 | Joseph et al. | 428/284 |
| 5,258,220 | A | | 11/1993 | Joseph | 428/284 |
| 5,271,883 | A | | 12/1993 | Timmons et al. | 264/6 |
| 5,308,691 | A | | 5/1994 | Lim et al. | 428/286 |
| 5,336,552 | A | | 8/1994 | Strack et al. | 428/224 |
| 5,344,297 | A | | 9/1994 | Hills | 425/131.5 |
| 5,366,793 | A | | 11/1994 | Fitts, Jr. et al. | 428/198 |
| 5,382,400 | A | | 1/1995 | Pike et al. | 264/168 |
| 5,405,682 | A | | 4/1995 | Shawyer et al. | 428/221 |
| 5,413,811 | A | | 5/1995 | Fitting et al. | 427/176 |
| 5,415,925 | A | | 5/1995 | Austin et al. | 428/287 |
| 5,418,045 | A | | 5/1995 | Pike et al. | 428/198 |
| 5,460,884 | A | | 10/1995 | Kobylivker et al. | |
| 5,492,751 | A | * | 2/1996 | Butt, Sr. et al. | 428/198 |
| 5,509,430 | A | | 4/1996 | Berger | 131/341 |
| 5,511,960 | A | | 4/1996 | Terakawa et al. | 425/7 |
| 5,601,851 | A | | 2/1997 | Terakawa | 425/72.2 |
| 5,616,408 | A | | 4/1997 | Oleszczuk et al. | |
| 5,632,944 | A | | 5/1997 | Blackwell | 264/72.15 |
| 5,633,082 | A | | 5/1997 | Berger | 428/365 |
| 5,635,134 | A | | 6/1997 | Bourne et al. | 422/26 |
| 5,652,048 | A | | 7/1997 | Haynes et al. | 442/351 |
| 5,665,300 | A | | 9/1997 | Brignola et al. | 264/555 |
| 5,695,376 | A | | 12/1997 | Datta et al. | 442/334 |
| 5,733,635 | A | | 3/1998 | Terakawa et al. | 428/198 |
| 5,733,822 | A | | 3/1998 | Gessner et al. | 442/35 |
| 5,759,926 | A | | 6/1998 | Pike et al. | 442/233 |
| 5,770,531 | A | | 6/1998 | Sudduth et al. | 442/361 |
| 5,783,503 | A | | 7/1998 | Gillespie et al. | 442/340 |
| 5,810,954 | A | | 9/1998 | Jacobs et al. | 156/62.4 |
| 5,814,404 | A | | 9/1998 | Rutherford et al. | 428/364 |
| 5,817,584 | A | | 10/1998 | Singer et al. | 442/345 |
| 5,935,883 | A | | 8/1999 | Pike | 442/340 |

* cited by examiner

FINE MULTICOMPONENT FIBER WEBS AND LAMINATES THEREOF

FIELD OF THE INVENTION

The present invention relates to meltblown fiber webs and, in particular, to multicomponent meltblown fiber webs and laminates thereof.

BACKGROUND OF THE INVENTION

Multicomponent spunbond fibers refer to fibers which have been formed from at least two polymer streams but spun together to form a unitary fiber. The individual components comprising the multicomponent fiber are usually different polymers and are arranged in distinct zones or regions that extend continuously along the length of the fibers. The configuration of such fibers can vary and commonly the individual components of the fiber are positioned in a side-by-side arrangement, sheath/core arrangement, pie or wedge arrangement, islands-n-sea arrangement or other configuration. Multicomponent fibers and methods of making the same are known in the art and, by way of example, are generally described in U.S. Pat. No. 5,344,297 to Hills; U.S. Pat. No. 5,336,552 to Strack et al. and U.S. Pat. No. 5,382,400 to Pike et al.

Generally, methods for making spunbond fiber nonwoven webs include extruding molten thermoplastic polymer through a spinneret, quenching the filaments and then drawing the quenched filaments with a stream of high velocity air to form a web of randomly arrayed fibers on a collecting surface. As examples, methods for making the same are described in U.S. Pat. No. 3,692,618 to Dorschner et al., U.S. Pat. No. 4,340,563 to Appel et al. and U.S. Pat. No. 3,802,817 to Matsuki et al. However, meltblown fabrics comprise a class of melt formed nonwoven fabrics which is distinct from those of spunbond fiber webs. Meltblown fiber webs are generally formed by extruding a molten thermoplastic material through a plurality of fine, usually circular, die capillaries as molten threads or filaments into converging high velocity, air streams which attenuate the filaments of molten thermoplastic material to reduce their diameter. Thereafter, the meltblown fibers are deposited on a collecting surface to form a web of randomly dispersed meltblown fibers. Meltblown fiber processes are disclosed in, for example, U.S. Pat. No. 3,849,241 to Butin et al.; U.S. Pat. No. 5,160,746 to Dodge et al.; U.S. Pat. No. 4,526,733 to Lau; and others. Meltblown fibers may be continuous or discontinuous and are generally smaller than about 10 microns in average diameter. In addition, meltblown fibers are generally tacky when deposited onto a collecting surface or other fabric.

Multicomponent meltblown fibers have been made heretofore. As an example, multicomponent meltblown fibers have been made to form a thermally moldable face mask such as, for example, as described in U.S. Pat. No. 4,795,668 to Krueger et al. Similarly, European Patent Application No. 91305974.4 (Publication No. 0466381 A1) teaches a conjugate meltblown fiber web suitable for thermally molding to the shape of a filter cartridge. In addition, U.S. Pat. No. 5,935,883 to Pike describes split multicomponent meltblown fibers and laminates thereof suitable for use in filter applications, wipers, personal care products and other uses.

However, there exists a need for multicomponent meltblown fiber webs which can be utilized to provide nonwoven webs and laminates thereof with varied structures and/or improved physical properties such as softness, strength, uniformity, peel strength and/or controlled barrier properties. Further, there exists a need for efficient and economical methods for making the same.

BRIEF SUMMARY OF THE INVENTION

The aforesaid needs are fulfilled and the problems experienced by those skilled in the art overcome by nonwoven webs of the present invention comprising fine multicomponent fibers having a first polymeric component and a second polymeric component positioned in distinct zones within the fiber's cross-section and which extend substantially continuously along the length of the fibers. The randomly interlaid web of extruded multicomponent fibers have an average fiber diameter less than 7 micrometers and comprise a first olefin polymer component and a second amorphous olefin polymer component. In one aspect, the first polymeric component comprises a crystalline propylene polymer and the second polymeric component comprises an amorphous propylene polymer. Further, the nonwoven web may have a hydrohead in excess of 50 mbar and a Frazier air permeability in excess of 100 cubic feet/minute/square foot.

In a further aspect of the present invention, nonwoven web laminates are provided comprising (i) a first nonwoven web of multicomponent fibers having a first polymeric component and a second polymeric component in distinct zones across the cross-section of the fibers which extend substantially continuously along the length of the fibers, said multicomponent fibers having an average fiber diameter less than about 7 micrometers; (ii) a second nonwoven web of continuous fibers having an average fiber diameter greater than about 10 micrometers; and (iii) a third nonwoven web of continuous fibers having an average fiber diameter greater than about 10 micrometers wherein the first layer is positioned between the second and third layers and further wherein the multilayer laminate has a hydrohead of at least 50 mbars, a Frazier air permeability in excess of 70 cubic feet/minute/square foot and cup crush energy of less than about 2150 g-mm. Desirably, the first layer comprises a meltblown fiber web and the second and third layers comprise spunbond fiber layers. In still a further aspect, the multilayer laminate may further comprise a fourth layer, such as a monocomponent meltblown fiber web, which is adjacent the first layer and also positioned between the second and third layers.

DESCRIPTION OF THE INVENTION

Nonwoven webs of the present invention comprise randomly interlaid webs of fine multicomponent fibers. The term "multicomponent" refers to fibers that have been formed from at least two polymer streams and extruded to form a unitary fiber. A specific species of multicomponent fibers is bicomponent fibers, which simply comprise fibers having two distinct components. The individual components of a multicomponent fiber are arranged in distinct regions in the fiber cross-section which extend substantially continuously along the length of the fiber. The nonwoven webs can be formed such that the fibers are still tacky when deposited and therefore become autogenously bonded at fiber contact points. The integrity of the web can, optionally, be improved by additional bonding steps such as, for example, additional thermal, ultrasonic and/or adhesive bonding. As a specific example, the fine multicomponent fiber web can be thermally point bonded at a plurality of thermal point bonds located across the fabric.

Figure 4A:
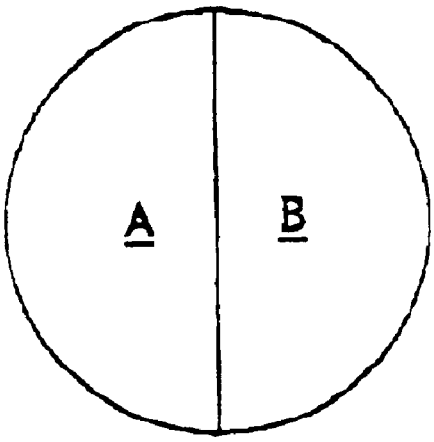
FIG. 4A is a schematic drawing illustrating the cross section of a multicomponent, fiber suitable for use with the present invention, with the polymer components A and B in a side-by-side arrangement.
Figure 4B:
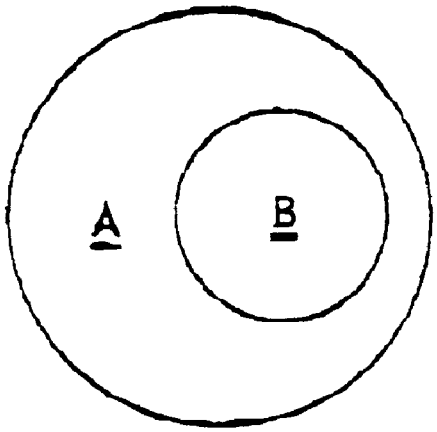
FIG. 4B is a schematic drawing illustrating the cross section of a multicomponent fiber, suitable for use with the present invention, with the polymer components A and B in an eccentric sheath/core arrangement.

The cross-sectional configuration of the multicomponent fibers can vary as desired. As examples, the individual components of the fiber can be positioned in a side-by-side arrangement, sheath/core arrangement, striped or other desired configurations. The multicomponent fibers comprise at least two distinct cross-sectional components and may comprise three or more components. As indicated above, the individual polymeric components collectively form the fiber cross-section. As an example, FIG. 4A discloses a specific embodiment of a bicomponent fiber having a side-by-side configuration wherein the two components are adjacent one another and each component occupies at least a portion of the periphery or outer surface of the fiber. As a further example and in reference to FIG. 4B, eccentric sheath/core configurations can be used in connection with the present invention. In eccentric sheath core fibers, one component fully occludes or surrounds the other but is asymmetrically located in the fiber. For bicomponent fibers, the respective polymer components can be present in ratios (by volume) of from about 90/10 to about 10/90 and desirably range between about 75/25 and about 25/75. Ratios of approximately 50/50 are often particularly desirable however the particular ratios employed can vary as desired. Additionally, the multicomponent fibers can also have various fiber shapes other than solid-round fibers such as, for example, hollow or flat (e.g. ribbon shaped) fibers.

Also, the multicomponent meltblown fiber webs can comprise crimped or uncrimped fibers. Crimp may be induced in multicomponent fibers by selecting polymeric components that have disparate stress or elastic recovery properties and/or crystallization rates. Such multicomponent fibers can form crimped fibers having a helical crimp wherein one polymer will substantially continuously be located on the inside of the helix.

Desirably the multicomponent meltblown fiber web has a basis weight of between about 5 g/m$^2$ and about 300 g/m$^2$ and still more desirably between about 10 g/m$^2$ and about 64 g/m$^2$. When used in a laminate structure the meltblown fiber web desirably has a basis weight between about 5 g/m$^2$ and about 34 g/m$^2$. The particular basis weight will vary with the specific application of the bicomponent meltblown fiber web and/or the corresponding laminate. As but one example, infection control products or medical fabrics desirably comprise a multicomponent meltblown fiber layer having a basis weight between about 12 g/m$^2$ and about 25 g/m$^2$. Additionally, the multicomponent meltblown fibers have a fiber diameter less than about 10$\mu$ and desirably have a diameter between about 0.5$\mu$ and about 7$\mu$ and still more desirably have a fiber diameter between about 2$\mu$ and about 5$\mu$.

The multicomponent meltblown fiber webs of the present invention can have excellent drape and softness and, as an example, multicomponent meltblown webs having a basis weight of about 34 g/m$^2$ or less can have a cup crush energy value of less than about 150 g-mm and more desirably less than about 100 g-mm. Further, the fabric softness can be achieved without the need for additional mechanical and/or chemical softening treatments. Additionally, the multicomponent meltblown fiber web can additionally have excellent bulk, air-permeability and/or tensile strength. In one aspect, the multicomponent meltblown fabrics of the present invention can comprise durable fabrics having machine direction Peak Strain (%) values of 40% or more and even in excess of about 50%. Additionally, the multicomponent meltblown fibers can provide high surface area fabric with good filtration efficiency while still also providing good air-permeability. For example, 20 g/m$^2$ multicomponent meltblown fiber webs (of 38 cm$^2$ fabric) can have air-permeability values of about 50 cubic feet per minute (CFM) or more and even air-permeability values of about 100 CFM or more. In addition, the multicomponent meltblown fabrics can have supported hydrohead values in excess of about 50 mbars.

The polymeric components of the multicomponent meltblown fibers can be selected from thermoplastic polymers suitable for use in making meltblown fiber webs such as, for example, polyolefins, polybutylenes, polyamides, polyesters, polyurethanes, acrylates (e.g. ethylene-vinyl acetates, ethylene methyl acrylates, etc.), EPDM rubbers, acrylic acids, polyamide polyether block copolymers, block copolymers having the general formula A-B, A-B-A or A-B-B-A such as copoly(styrene/ethylene-butylene), styrene-poly(ethylenepropylene)-styrene, styrene-poly (ethylene-butylene)-styrene, as well as other polymers suitable for use in meltblown processes. In addition, blends and/or copolymers of the aforesaid polymers are likewise suitable use in one or more components of the meltblown fiber. Further, highly amorphous polymers and/or tacky resins which are commonly used as adhesives can also be used as one or more components of the multicomponent fiber. Examples include, but are not limited to, amorphous polyalphaolefins such as for example, ethylene/propylene copolymers such as the REXTAC family of amorphous polyalphaolefins from Huntsman Corp. and VESTOPLAST polymers from Creanova AKG.

By way of example only, desired combinations of polymers can comprise polyolefin/polyamide; polyolefin/polyester, polyolefin/polyolefin and so forth. More particularly, examples of suitable polymeric component combinations include, but are not limited to, polypropylene/polyethylene (e.g., conventional polypropylene/linear low density polyethylene, conventional polypropylene/polyethylene elastomer, polypropylene elastomer/polyethylene elastomer, polyethylene/ethylene-propylene copolymers, etc.);

polypropylene/polypropylene (e.g., conventional polypropylene/amorphous polypropylene, inelastic polypropylene/elastic polypropylene, polypropylene/ethylene-propylene copolymers, etc.); polyethylene/nylon (e.g., polyethylene/nylon 6, polyethylene/nylon 6,6 etc.); polyethylene/polyester (e.g. polyethylene/polyethylene terephthalate, etc.). In one aspect of the invention, the polymers comprising the respective components of the multicomponent meltblown fiber can have a melting point at least 10° C. apart and still more desirably have a melting point at least about 20° C. apart. By selecting polymers with disparate melting points it is possible to improve bonding of laminate structures without significantly degrading the fibrous structure of the meltblown fiber web. This may be advantageous in maintaining the desired level of porosity, barrier properties and/or pressure drop across the fabric thickness.

As a specific example, the multicomponent meltblown fibers can comprise a first component comprising a first propylene polymer and a second component comprising a second propylene polymer wherein the second propylene polymer has a narrow molecular weight distribution and a polydispersity number less than that of the first polypropylene polymer. As an example, the first propylene polymer can comprise conventional polypropylene and the second propylene polymer can comprise a "single-site" or "metallocene" catalyzed polymer. As used herein, "conventional" polypropylene refers to those made by traditional catalysts such as, for example, Zeigler-Natta catalysts. Conventional polypropylene polymers include substantially crystalline polymers such as, for example, those made by traditional Zeigler-Natta catalysts and typically have a polydispersity number greater than about 2.5. As an example, conventional polypropylene is commercially available from Exxon Chemical Company of Houston, Tex. under the trade name ESCORENE. Exemplary polymers having a narrow molecular weight distribution and low polydispersity (relative to conventional polypropylene polymers) include those catalyzed by "metallocene catalysts", "single-site catalysts", "constrained geometry catalysts" and/or other comparable catalysts. Examples of such catalysts and polyolefin polymers made therefrom are described in those described in U.S. Pat. No. 5,451,450 to Elderly et al.; U.S. Pat. No. 5,204,429 to Kaminsky et al.; U.S. Pat. No. 5,539,124 to Etherton et al.; U.S. Pat. No. 5,118,768 to Job et al.; U.S. Pat. Nos. 5,278,272 and 5,272,236, both to Lai et al.; U.S. Pat. No. 5,554,775 to Krishnamurti et al.; and U.S. Pat. No. 5,539,124 to Etherton et al.; the entire contents of the aforesaid references are incorporated herein by reference. Commercially available polymers made with such catalysts are available from Dow Chemical Company under the trade name ENGAGE, from DuPont-Dow under the trade name ENGAGE and from Exxon Chemical Company under the trade name ACHIEVE. As a specific example, the multicomponent fibers can comprise a first component of a propylene polymer having a polydispersity number of about 3 or more and a second polymer component comprising a propylene polymer having a polydispersity number less than about 2.5.

In a further aspect, the fine multicomponent fibers can comprise a first olefin polymer component and a second olefin polymer component wherein the second polymer has a lower density than the first olefin polymer. Still further, the first component can comprise a substantially crystalline polypropylene and the second component can comprise an amorphous polypropylene, that is to say a polypropylene polymer having a lower degree of crystallinity. Desirably the first component has a crystallinity, as measured by the heat of fusion ($\Delta H_f$), at least about 25 J/g greater than that of the second component and, still more desirably, has a crystallinity of at least about 40 J/g greater than that of the second component. As a particular example, the first component can comprise conventional polypropylene and the second component can comprise an amorphous polypropylene. In one aspect, the relative degree of crystallinity and/or polymer density can be controlled by the degree branching and/or the relative percent of isotactic, syndiotactic and atactic regions within the polymer. As indicated above, conventional polyolefins generally comprise substantially crystalline polymers and generally have a crystallinity in excess of 70 J/g and more desirably, however, have a crystallinity of about 90 J/g or more. In one aspect, the amorphous propylene polymers desirably have a crystallinity of about 65 J/g or less. The degree of crystallinity, or heat of fusion ($\Delta H_f$), can be measured by DSC in accord with ASTM D-3417.

Exemplary propylene based amorphous polymers believed suitable for use with the present invention are described in U.S. Pat. No. 5,948,720 to Sun et al.; U.S. Pat. No. 5,723,546 to Sustic et a.; European Patent No. 0475307B1 and European patent No. 0475306B1; the entire content of the aforesaid references are incorporated herein by reference. As further specific examples, the amorphous ethylene and/or propylene based polymers desirably have densities between about 0.87 g/cm$^3$ and 0.89 g/cm$^3$. However, various amorphous polypropylene homopolymers, amorphous propylene/ethylene copolymers, amorphous propylene/butylene copolymers, as well as other amorphous propylene copolymers believed suitable for use in the present invention are known in the art. In this regard, stereoblock polymers are believed well suited for practicing the present invention. The term "stereoblock polymer" refers to polymeric materials with controlled regional tacticity or stereosequencing to achieve desired polymer crystallinity. By controlling the stereoregularity during polymerization, it is possible to achieve atactic-isotactic stereo blocks. Methods of forming polyolefin stereoblock polymers are known in the art and are described in the following artides: G. Coates and R. Waymouth, "Oscillating Stereocontrol: A Strategy for the Synthesis of Thermoplastic Elastomeric Polypropylene" 267 Science 217–219 (January 1995); K. Wagener, "Oscillating Catalysts: A New Twist for Plastics" 267 Science 191 (January 1995). Stereoblock polymers and methods of their production are also described in U.S. Pat. No. 5,549,080 to Waymouth et al. and U.S. Pat. No. 5,208,304 to Waymouth. As indicated above, by controlling the crystallinity of alpha-olefins it is possible to provide polymers exhibiting unique tensile modulus and/or elongation properties. Suitable commercially available polymers include, by way of example only, those available from Huntsman Corporation under the trade name REXFLEX FLEXIBLE POLYOLEFINS.

In one embodiment, the first and second components can each comprise distinct olefin elastomers. When both of the polymeric components comprise elastomers, the resulting multicomponent meltblown fibers can exhibit good stretch and recovery characteristics. As a further example, the first component can comprise an inelastic polyolefin and the second component can comprise a polyolefin elastomer. As an example, the inelastic polyolefin polymer can comprise conventional polypropylene and the polyolefin elastomer can comprise a stereoblock and/or amorphous polyolefins as described above. Additional elastic polyolefins believed suitable for use in combination with an inelastic polyolefin component, include but are not limited to "single site,"

"metallocene" or "constrained geometry" catalyzed polyolefin elastomers as discussed herein. In this regard, specific examples of polymer combinations believed suitable with the present invention include conventional polypropylene with a polyethylene elastomer having a density below 0.89 g/cm$^3$ and, more desirably, having a density between about 0.86 g/cm$^3$ and about 0.87 g/cm$^3$. Polyethylene elastomers can be made by metallocene or constrained geometry catalysts and, as an example, are generally described in U.S. Pat. No. 5,322,728 to Davey et al. and U.S. Pat. No. 5,472,775 to Obijeski et al. Still further, a first component can comprise a linear low-density polyethylene (having a density of about 0.91 g/cm$^3$ to about 0.93 g/cm$^3$) and the second component can comprise a polyethylene elastomer. Still further, the first component can comprise a stereoblock polypropylene and the second component can comprise a polyethylene elastomer.

The multicomponent fibers can also comprise a first component comprising propylene, such as conventional polypropylene, and a second component comprising a propylene/ethylene copolymer such as, for example, a random copolymer of propylene and ethylene comprising a minor portion of ethylene. An exemplary propylene-ethylene random copolymer is commercially available from Union Carbide Corp. under the designation 6D43 which comprises about 3% ethylene. Additional propylene-ethylene copolymers believed suitable for use with the present invention include olefin multi-step reactor products wherein an amorphous ethylene propylene random copolymer is molecularly dispersed in a predominately semi-crystalline high propylene monomer/low ethylene monomer continuous matrix. Examples of such polymers are described in European Patent No. 400,333B1 and U.S. Pat. No. 5,482,772 to Strack et al.; the entire contents of which are incorporated herein by reference. Such polymers are commercially available from Himont, Inc., under the trade name CATALLOY polymers.

In a further aspect, a first component can comprise a low melt-flow rate (MFR) polyolefin and a second component can comprise a high melt-flow rate olefin polymer. As a particular example, a bicomponent fiber can comprise a polyethylene such as, for example, linear low-density polyethylene, and the second component can comprise a polypropylene having a MFR in excess of 800 g/10 min. at 230° C. As a further example, the first component can comprise a low melt-flow rate polypropylene, having a MFR less than 800 g/10 min. at 230° C., and the second component can comprise a high melt-flow rate polypropylene, having a MFR in excess of 800 g/10 min. at 230° C. High melt-flow rate polymers and methods of making the same are known in the art. As an example, high melt-flow rate polymers are described in commonly assigned U.S. Pat. No. 5,213,881 to Timmons et al., the entire contents of the aforesaid reference is incorporated herein by reference. Melt-flow rate (MFR) can be determined before the polymer is melt-processed in accord with ASTM D1238-90b; the specific test conditions (i.e. temperature) will vary with the particular polymer as described in the aforesaid test. Test conditions for polypropylene are 230/2.16 and 190/2.16 for polyethylene.

Further, the multicomponent fibers can comprise a first component comprising a first polyolefin and a second component comprising a polyolefin blend. The polyolefin blend can comprise, in part, the same or different polyolefin as that in the first component. Further, the first polyolefin can optionally comprise a distinct polymer blend. As an example, the first component can comprise a conventional polypropylene and the second component can comprise a blend of a conventional polypropylene and an amorphous polypropylene. As a further example, the first component can comprise polypropylene and the second component can comprise a blend of an identical or similar polypropylene and a propylene/butylene random copolymer. The propylene/butylene copolymer within a component desirably comprises between about 0.5% and about 50%, by weight, of the polymer blend. An exemplary propylene/butylene random copolymer is a polymer with the trade designation DS4D05 which is commercially available from Union Carbide and which comprises about 14% butylene. As a further example, the first component can comprise polypropylene and the second component can comprise a blend of polyethylene and a propylene/butylene copolymer. Still further, the first component can comprise a propylene/ethylene random copolymer and the second component a blend of polypropylene and a propylene/butylene random copolymer. Further, the first component can comprise conventional polypropylene and the second component can comprise a blend of a random copolymer of propylene and ethylene and a propylene/butylene random copolymer. The above identification of specific polyolefin polymer blends is not meant to be limiting as additional combinations of polymers and/or blends thereof are believed suitable for use with the present invention.

In a further aspect, the first component can comprise a first inelastic or elastic polyolefin and the second component can comprise a non-polyolefin thermoplastic elastomer. Desirably, the first component can comprises a first inelastic or elastic polyolefin and the second component can comprise a blend of a polyolefin and a non-polyolefin thermoplastic elastomer. Exemplary thermoplastic elastomers include, by way of example only, elastomers made from block copolymers having the general formula A-B-A' where A and A' are each a thermoplastic polymer end block which contains a styrenic moiety such as a poly (vinyl arene) and where B is an elastomeric polymer midblock such as a conjugated diene or a lower alkene polymer. As an example, an exemplary elastomer comprises (polystyrene/poly(ethylene-butylene)/polystyrene) block copolymers available from the Shell Chemical Company under the trademark KRATON and suitable polyolefin blends are described in U.S. Pat. No. 4,663,220 to Wisneski et al., the entire contents of which are incorporated herein by reference. The elastomeric thermoplastic elastomers within the blends desirably comprise between about 5% and about 95%, by weight, of the polymeric portion of the component and still more desirably comprises at least about 50%, by weight, of the polymeric portion of the component.

Figure 3:
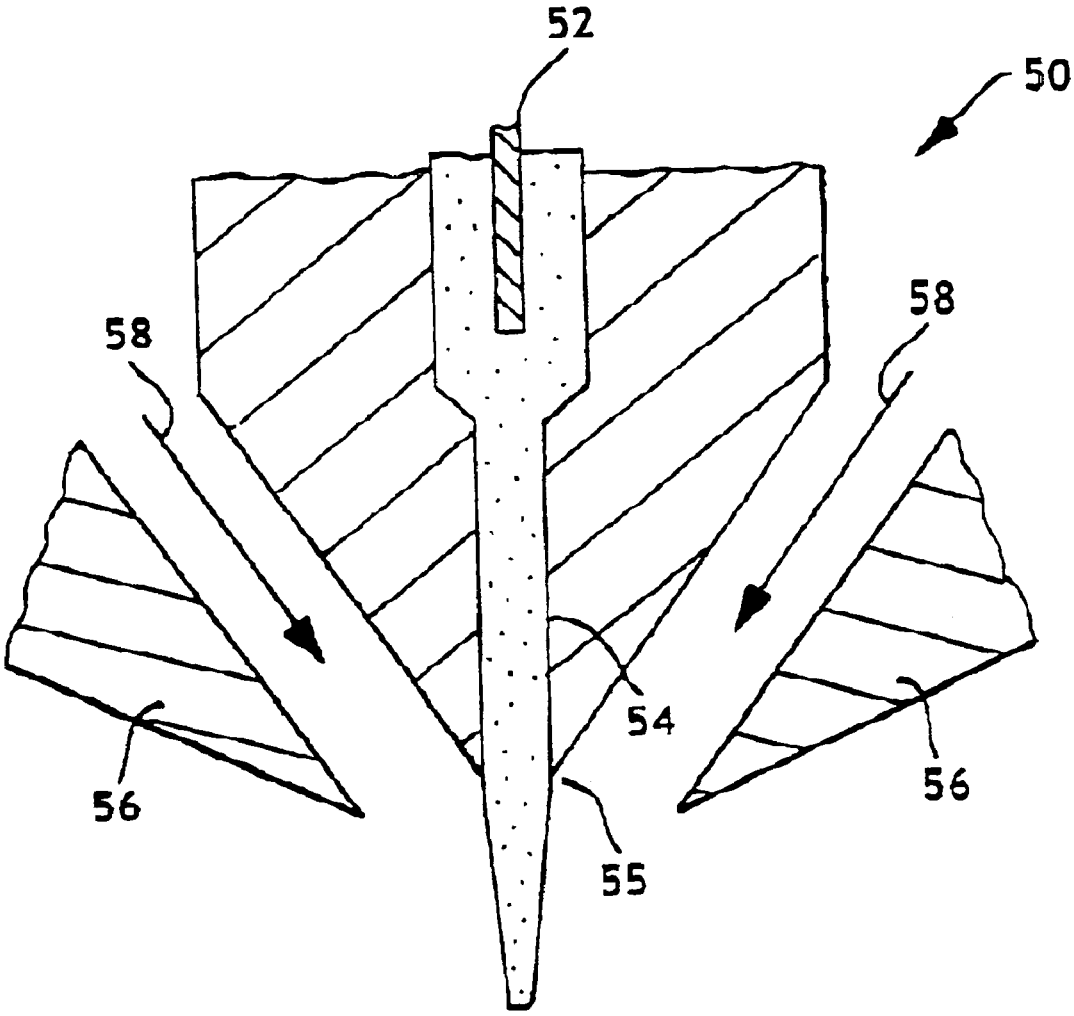
FIG. 3 is a cross-sectional view of a meltblowing die suitable for making multicomponent meltblown fabrics.

Multicomponent meltblown fibers can be made by simultaneously extruding two or more polymer streams through each orifice of the meltblown die. In reference to FIG. 3, a meltblown die 50 can utilize a divider plate 52 to maintain the separation of a first polymer stream of polymer A and second polymer stream of polymer B up to and until the polymers reach the die capillary 54. The polymers are desirably fed to the meltblown die via separate conduits and kept separate until just prior to extrusion. Air plates 56 can provide a channel 58, adjacent die 50, which direct the attenuating air past die tip 55. The molten polymer is extruded from die tip 55 and drawn by the primary air, which moves through channels 58 in the direction of the arrows associated therewith. Methods and apparatus for making multicomponent nonwoven webs are also described in U.S. Pat. No. 3,425,091 to Ueda et al.; U.S. Pat. No. 3,981,650 to Page; and U.S. Pat. No. 5,601,851 to Terakawa et al.

In conventional meltblowing apparatus and processes the primary air is maintained at a temperature above the melting point of the polymer. Thus, when using conventional meltblowing apparatus the primary or attenuating air will typically have a temperature above the melting point of each of the polymers comprising the individual polymeric components. However, as discussed in more detail herein below, the primary or attenuating air can, optionally, have a temperature above or below the melting point of one or more of the extruded polymers. The multicomponent meltblown fibers and resulting webs can be made in accord with meltblowing processes such as, for example, those described in U.S. Pat. No. 3,849,241 to Butin et al.; U.S. Pat. No. 5,160,746 to Dodge et al.; U.S. Pat. No. 4,526,733 to Lau; U.S. Pat. No. 5,652,048 to Haynes et al.; U.S. Pat. No. 5,366,793 to Fitts et al. and Naval Research Labratory Report No. 4364 entitled "Manufacture of Superfine Organic Fibers" by V. Wente, E. Boone and C. Fluharty; the entire contents of the aforesaid references are incorporated herein by reference. In addition, melt spray equipment can likewise be used and/or adapted to create such multicomponent fibers and, by way of example only, exemplary melt spray apparatus and processes are generally described in U.S. Pat. No. 4,949,668 to Heindel et al.; U.S. Pat. No. 4,983,109 to Miller et al. and U.S. Pat. No. 5,728,219 to Allen et al.

Conventional meltblown systems can be used to make multicomponent meltblown fiber webs of the present invention and such systems typically use hot air to keep the fiber molten and to draw the fiber. However, as indicated above, a variety of combinations of polymeric components can be utilized in connection with the present invention and, in this regard, due to the disparity in melting points, quench rates and other characteristics of these polymers it will often be advantageous to primarily attenuate the extruded multicomponent fibers to the desired fiber diameter with "cold" air. As used herein the term cold air refers to air below the melting point of at least one of the polymeric components. In a further aspect, multicomponent meltblown fibers can be primarily attenuated to the desired diameter with air at a temperature below the melting point of the lowest melting polymeric component. Once the meltblown fibers have been attenuated to reach desired diameters, the process must allow for quenching, or cooling, of the fiber to solidify it. Multicomponent meltblown fibers can be made using a coflowing hot air/cold air meltblown system wherein only enough hot air necessary to heat the die tip is used. In this regard and in reference to FIGS. 5 and 6, the draw force on the fiber can be provided primarily by the primary cold air flows 104, while just enough heated air is provided by secondary hot air flows 106 to keep the fiber warm during the drawing step. In this regard, utilization of cold air immediately adjacent to the die opening 111 can cause the die to plug due to the solidification of the polymer. Thus, the primary air 104 and secondary air 106 are desirably provided in a proportion that uses more primary cold air than secondary hot air for providing the drawing force for the formation of fibers. While hot air usage may be minimized, a minimum amount of hot air is needed to maintain the viscosity of the polymer at a level that is suitable for drawing the fiber. The total flow of air (based on total flow rate in pounds per inch per hour) may be composed of from about 5% to about 80% hot air flow and from about 20% to about 95% cold air flow. More desirably, a hot air flow of from about 20% to about 50% may be utilized and still more desirably, a flow of 70% primary cold air and 30% secondary hot air may be utilized.

The fiber-forming polymer can be provided to a die apparatus by various equipment (not shown) such as a reservoir for supplying a quantity of fiber-forming thermoplastic polymer resins to an extruder driven by a motor. The polymers comprising the respective components are desirably separated until they reach the die capillary. A primary flow of cold attenuating fluid, at a temperature below the melting point temperature of the particular polymers being used to form the fibers, is provided to a die by a blower and a secondary flow of heating fluid, preferably air, is provided to a die by a second blower. Generally described, meltblown fibers originate from the discharge opening of a die and are attenuated by the draw air and then collected on a continuous, moving foraminous screen or belt into a nonwoven web. The fiber forming distance is thus the distance between the upper surface of collecting surface and the plane of the discharge opening of the die. Further, as is known in the art, collection of the attenuated fibers on the belt may be aided by a suction box.

Figure 5:
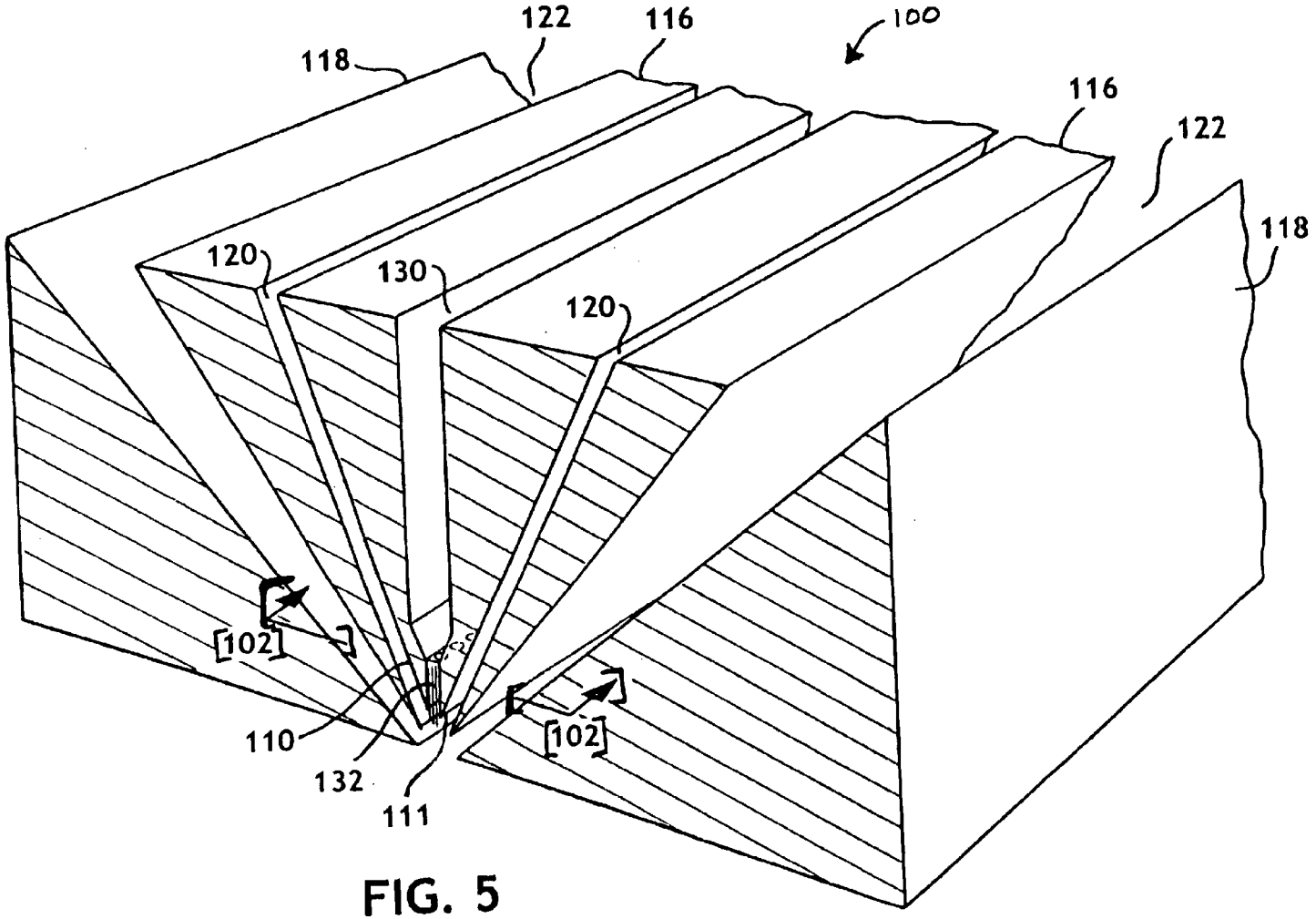
FIG. 5 is a schematic representation of an elevated perspective view of a die suitable for practicing present invention.

An exemplary embodiment of the fiber-forming portion of a meltblown die is shown schematically in FIG. 5 and is designated generally by the numeral 100. As shown therein, the fiber-forming portion of die apparatus 100 includes a die tip 110 that is connected to the die body (not shown) in a conventional manner. Die tip 110 is formed generally in the shape of a prism (normally an approximate 60° wedge-shaped block) that defines a knifeedge or opening 111. Die tip 110 is further defined by a pair of opposed side surfaces 112, 114. The knifeedge at die tip 110 forms the apex of an angle that desirably ranges from about 30° to 60°.

As shown in FIG. 5, die tip 110 defines a polymer supply passage 130 that terminates in further passages 132 defined by die tip 110 which are commonly referred to as capillaries. Capillaries 132 are individual passages that communicate directly with opening 111 and that generally run substantially the length of die tip 110. A divider (not shown) can separate polymer streams A and B until substantially through the length of passage 130 and adjacent capillary 132. In reference to FIG. 6, which is an enlarged cross-sectional view of die tip 110, capillaries 132 generally have a diameter that is smaller than the diameter of polymer supply passage 130. Typically, the diameters of all the capillaries 132 will be the same so as to have uniform fiber size formation. The diameter of the capillaries 132 is indicated on FIG. 6 the double arrows designated "d, d." A typical capplary diameter "d" is 0.0145 inches. The length of the capillary 132 is indicated on FIG. 6 by the designating letter "L". Capillaries 132 desirably have a 10/1 length/diameter ratio.

Figure 6:
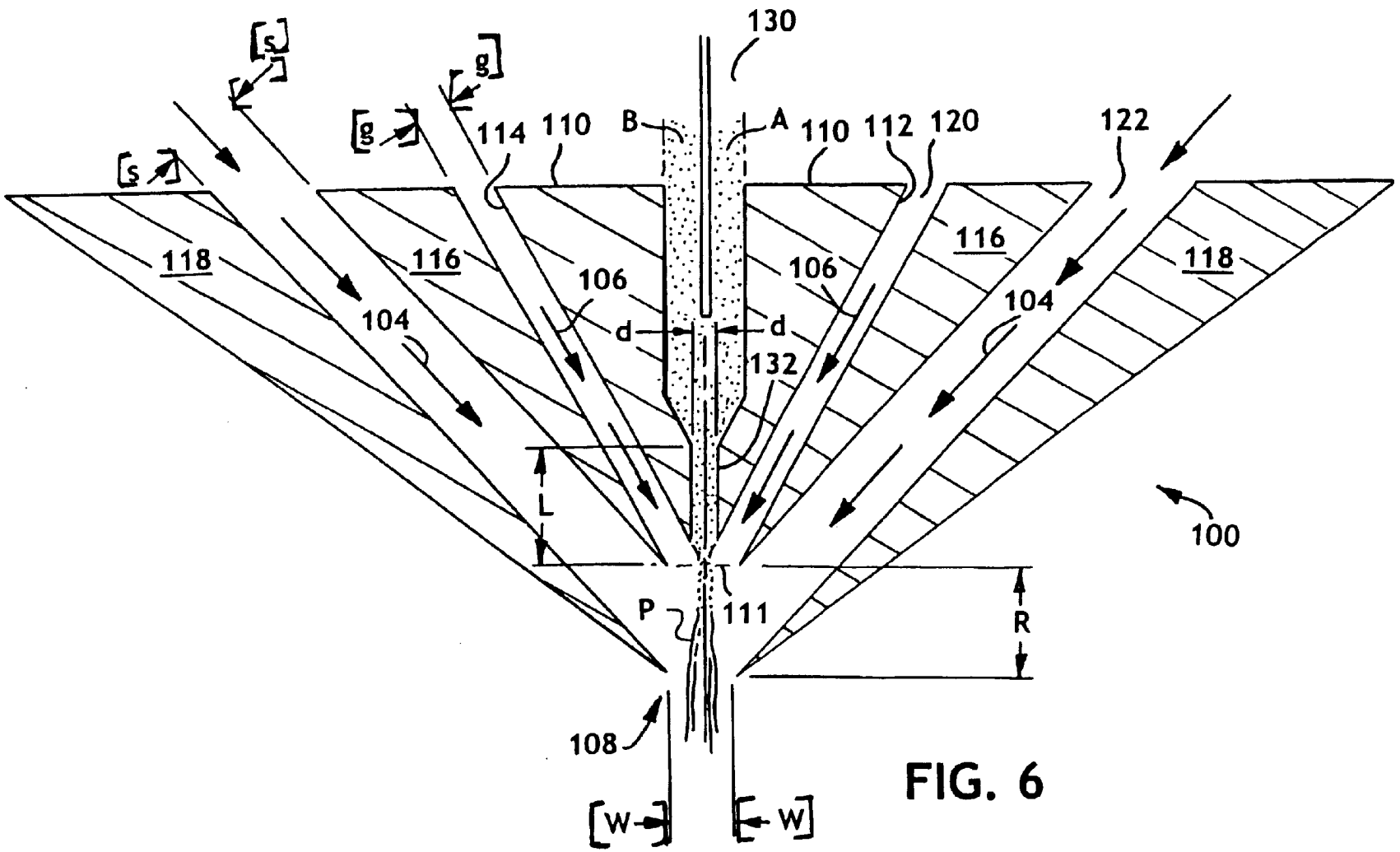
FIG. 6 is a schematic representation of a cross-sectional view of the meltblowing nozzle, looking in the direction of arrows numbered 102—102 in FIG. 5.

As shown in FIG. 6 for example, capillary 132 is configured to expel liquid polymer through exit opening 108 as a liquid polymer stream, which is designated by the letter "P." The liquid polymer stream P exits through exit opening 108 in die tip 110 and flows in a direction generally parallel to that of the capillaries 132. In reference to FIGS. 5 and 6, the fiber-forming portion of the die apparatus 100 includes first and second inner walls 116 disposed generally opposite each other to form a mirror image. Inner walls 116 are also known as "hot air plates" or "hot plates." As shown in FIGS. 5 and 6, hot air plates 116 are configured and disposed to cooperate with die tip 110 in order to define first and a second secondary hot air flow channel 120. The secondary hot air channels 120 are located with respect to die tip 110 so that hot air flowing through the channels will shroud die tip 110.

The secondary hot air channels 120 are the channels along which a hot air stream moves during use so that die tip 110 can remain at a sufficiently high temperature to ensure that the polymer stream P will not prematurely quench, or solidify, so that it may be drawn by the cold primary air. In addition, the hot air shroud formed by cooperating secondary hot air channels 120 prevents polymer at or near the die tip 110 from freezing and breaking off. First and second outer walls 118 are also referred to as "cold air plates" or "cold plates", are configured and disposed to cooperate with the outer surface of hot air plates 116to define first and second primary cold air channels 122 therebetween. The distance "R" that the cold air plates 118 extend below the plane created by hot air plates 116 can vary and, in another aspect, the cold air plates can be positioned parallel with (R=0) or slightly above the plane created by hot air plates 116. The first and second primary cold air channels 122 are configured to direct a substantial quantity of fluid flowing through the channels in a direction substantially parallel to the axis of the capillary 132. In other words, the direction of the fluid that will flow through the first and second cold air channels can be resolved into a component of flow that is generally parallel to the polymer flow through capillary 132.

The first and second primary cold air channels are configured to be in connecting communication with a primary cold fluid source means. The primary cold fluid source means is provided for supplying to each of first and second primary cold air channels, a primary forced flow of fluid, preferably air, that is cold relative to the secondary hot air and molten polymer, i.e., at a temperature that is less than at least one of the melting points of the polymers being meltblown. Although this temperature may vary, in certain arrangements it may be in the range of from about 25° C. to about 150° C. The cold primary air acts to substantially attenuate the extruded fiber as well as quench the same.

The particular velocities of cold air flow and hot air flow will depend on the amount of drawing force needed on the fibers, which will vary depending on the particular polymer, the temperatures utilized, and the like. Usually, the velocities for the cold airflow and the hot air flow will be relatively identical. However, there can be up to a 20% difference between the velocities, with the hot air flow velocity usually being greater than the cold air flow velocity. Care, however, should be taken to ensure that turbulence and fiber vibration does not hinder fiber formation when varying velocities are employed. More detailed description apparatus and methods of forming meltblown fiber webs using cold air is described in U.S. patent application Ser. No. 08/994,37 led Dec. 19, 1997 to Haynes et al., the entire contents of which is incorporated herein by reference.

Figure 1:
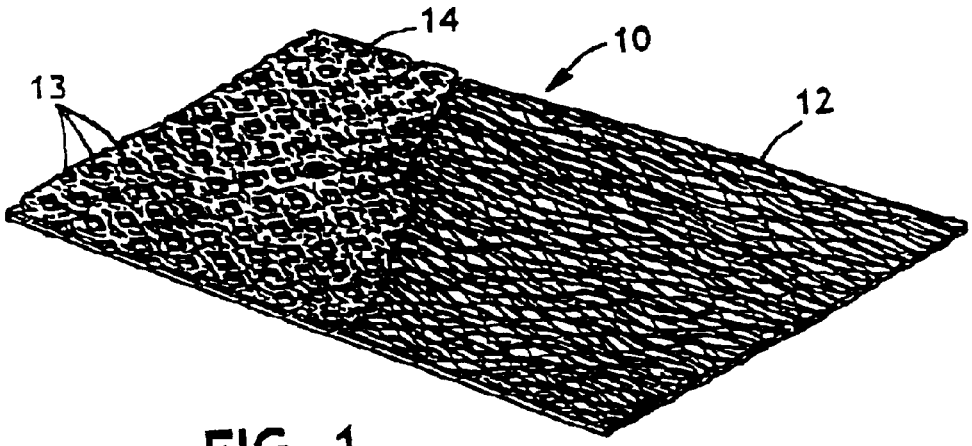
FIG. 1 is a partially broken-away view of a multilayer nonwoven laminate incorporating a multicomponent meltblown fiber web.
Figure 2:
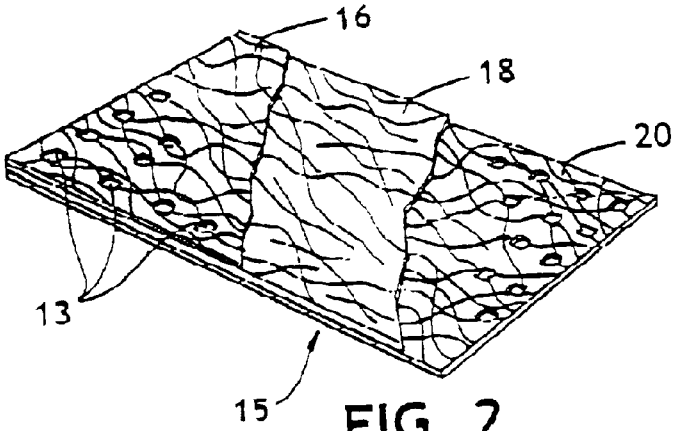
FIG. 2 is a partially broken-away view of a multilayer nonwoven laminate incorporating a multcomponent meltblown fiber web.

The fine fiber nonwoven webs of the present invention are also particularly well suited for use in multilayer laminates. In reference to FIG. 1, a multilayer nonwoven laminate 10 is provided comprising a multicomponent meltblown fiber web 12 laminated to sheet-like layer 14 such as, for example, a nonwoven web of spunbond fibers. In a particular aspect and in reference to FIG. 2, the multilayer laminate can comprise a three layer laminate 15 such as, for example, an intermediate layer of multicomponent meltblown fibers 18 between a first spunbond fiber web 16 and a second spunbond fiber web 20 to form a spunbond/meltblown/spunbond (SMS) nonwoven laminate.

The sheet or sheet-like material can comprise one or more layers of material such as a film, nonwoven web, scrim, foam, woven fabric and/or other material. Desirably the sheet material comprises a thermoplastic polymer such as a polyolefin, polyamide, polyester, polyurethane and blends and copolymers thereof. The sheet material can comprise an extensible or non-extensible fabric and/or can comprise an elastic or inelastic fabric. In a preferred embodiment of the present invention the multicomponent meltblown fiber web is fixedly attached to a sheet material comprising one or more nonwoven webs. As used herein the term "nonwoven" fabric or web means a material having a structure of individual fibers or threads which are interlaid, but not in an identifiable manner as in a knitted or woven fabric. Nonwoven fabrics or webs have been formed by many processes such as, for example, meltblowing processes, spunbonding processes, hydroentangling, air-laid and bonded carded web processes. Additional laminate structures and suitable materials for forming the same are discussed herein below in greater detail.

The sheet material can be made in-line or unwound from a winder roll and directed under a multicomponent meltblown die thereby forming the multicomponent fibers directly upon the sheet material. Meltblown fibers are often tacky when deposited and thus, depending upon the intended use or application of the laminate, further bonding between the two layers may be unnecessary. However, it will often be desirable to increase the peel strength of the laminate by additional bonding processes. In this regard, the cohesion between the layers can be increased as desired by one or more means known in the art such as, for example, by thermal, ultrasonic and/or adhesively bonding the layers together. As an example, sheet 14 and multicomponent meltblown fiber web 16 can be pattern bonded such as, for example, by point bonding. As used herein "point bonding" means bonding one or more layers of fabric at numerous small, discrete bond points. As a specific example, thermal point bonding generally involves passing one or more layers to be bonded between heated rolls such as, for example, an engraved or patterned roll and a second roll. The engraved roll is patterned in some way so that the fabric is not bonded over its entire surface, and the second roll can either be flat or patterned. As a result, various patterns for engraved rolls have been developed for functional as well as aesthetic reasons. Desirably the multilayer laminates are pattern bonded such that the bonded area comprises less than 50% of the fabric surface area and still more desirably the bonded area comprises between about 5% and about 30% of the fabric surface area. Exemplary bond patterns and/or bonding processes suitable for use with the present invention include, but are not limited to, those described in U.S. Des. Pat. No. 356,688 to Uitenbroek et al; U.S. Pat. No. 4,374,888 to Bomslaeger; U.S. Des. Pat. No. 3,855,046 to Hansen et al.; U.S. Pat. No. 5,635,134 to Bourne et al.; and U.S. Pat. No. 5,858,515 to Stokes et al.; and PCT Application U.S. Ser. No. 94/03412 (publication no. WO 95/09261). In reference to FIG. 2, a multilayer laminate 15 is provided having excellent peel strength with the outer layers 16, 20 and intermediate multicomponent meltblown layer 18 are bonded together at a plurality of discrete bond points 13. Various methods of forming cohesive multi-layer laminates are further described herein below in greater detail.

Multicomponent meltblown web laminates, such as an SMS laminate, desirably have excellent drape and correspondingly low cup crush values. SMS laminates of the present invention can have a cup crush energy value of less than 2150 g-mm and still more desirably have a cup crush energy value of less than about 2050 g-mm. Such cup crush values can be achieved without the need for additional mechanical and/or chemical softening processes. The meltblown fiber webs and/or laminates of the present invention can, however, be further mechanically and/or chemically softened such as, for example, as described in U.S. Pat. No. 5,413,811 to Fitting et al. and U.S. Pat. No. 5,810,954 to Jacobs et al. Additionally, the SM and/or SMS laminates can have excellent tensile strength and/or peel strength (i.e.

resistance to delamination). Still further, the ,multicomponent meltblow fiber webs and laminates thereof can have good barrier properties such as, for example, hydrohead values in excess of about 50 mbars and even in excess of about 80 mbars. Additionally, the fine multicomponent fiber webs and/or laminates thereof can also have BFE (bacteria filtration efficiency) values in excess of about 95% and still further can have a BFE in excess of about 98%.

The multicomponent meltblown fiber web can be formed alone or in an in-line process such as generally described, for example, in U.S. Pat. No. 5,271,883 to Timmons et al. and U.S. Pat. No. 4,041,203 to Brock et al. In reference to FIG. 7, a process for forming a multilayer laminate is described comprising a series of nonwoven machines to produce a cohesive multilayer laminate 88 in a continues, in-line process. One or more banks of spunbond machines 64 deposit spunbond fibers 65 upon continuous foraminous surface 62. Vacuum box 63 can be placed underneath the forming surface to aid in formation of the web. Numerous spunbond fiber processes and apparatus are known in the art such as, for example, those described in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. The spunbond fibers can either be crimped or uncrimped fibers. Further, the spunbond fibers can themselves be monocomponent fibers, multiconstituent fibers, multicomponent fibers or other fiber forms. In a particular embodiment of the present invention, the spunbond fiber web created by spunbond machine(s) can comprise a polyolefin fiber web having a basis weight between about 7 $g/m^2$ and about 170 $g/m^2$ and still more desirably between about 12 $g/m^2$ and about 50 $g/m^2$. Additionally, the spunbond fibers desirably have a fiber diameter less than about 50$\mu$ and more desirably between about 10$\mu$ and about 25$\mu$. In one aspect of the invention, the polyolefin spunbond fibers can comprise polypropylene spunbond fibers. In a further aspect of the invention, the spunbond fibers can comprise multicomponent fibers. Exemplary multicomponent spunbond fiber nonwoven fabrics include, but are not limited to, those described in U.S. Pat. No. 5,382,400 to Pike et al.; U.S. Pat. No. 5,622,772 to Stokes et. al.; U.S. Pat. No. 5,695,849 to Shawver et al.; U.S. patent application Ser. No. 08/671,391 to Griesbach et al.; the entire contents of the aforesaid references are incorporated herein by reference. In one aspect, the spunbond fibers can comprise, at least in part, a similar and/or identical polymer to that comprising one of the components of the multicomponent meltblown fabric. Still further, the spunbond fiber can comprise a polymer having the same or similar melting point as the polymer comprising the lower melting component of the multicomponent meltblown fiber web.

The spunbond fibers 65 can be deposited upon foraminous surface 62 that travels in the direction of the arrows associated therewith. The spunbond fiber layer 66 travels, upon forming surface 62, underneath a first bank of multicomponent meltblown fiber machines 70 which deposits multicomponent meltblown fibers directly upon the spunbond fibers. Vacuum box 63 can be positioned underneath the forming surface 62, proximate meltblown machine 72, to aid in formation of the meltblown fiber web. Polymers A and B can be fed via separate conduits from reservoirs 67 and 68 to meltblown machine 70. One or more layers of meltblown fiber webs can be formed thereover as desired. In reference to FIG. 7, three consecutive meltblown machines 70, 74 and 78 are shown each depositing respective layers of meltblown fibers 72, 76 and 80. However, each meltblown layer need not be multicomponent meltblown nor does each layer need to comprise the same combination of polymeric components. As an example, one or more of the meltblown fiber layers can comprise distinct polymer combinations. Desirably, however, each of the meltblown and spunbond fiber webs have at least one substantially similar or identical polymer.

Subsequent to the deposition of meltblown fiber layers 72, 76 and 80, spunbond fibers 83 can be deposited over the forming surface by spunbond boak 82 in particular, over the upper most meltblown fiber web 80, to form spunbond fiber layer 84. One or more additional layers of spunbond or other fibers can be deposited thereover as desired. Additionally, the second spunbond layer 84 can comprise identical, similar and/or a distinct material relative to the underlying spunbond fiber layer 66. As an example, one spunbond layer can be selected to provide excellent hand whereas the other can be selected to provide improved tensile strength, abrasion resistance, or other desired characteristics.

The multiple layers can then be treated to increase the peel strength of the resulting laminate. The layers can be bonded together by one or more means known in the art such as, for example, adhesively, thermally, and/or ultrasonically bonding. In reference to FIG. 7, the multiple layers can be fed through nip 87 formed by first and second rollers 86A and 86B to thermally point bond the multiple layers of the fabric thereby forming multilayer laminate 88.

Figure 7:
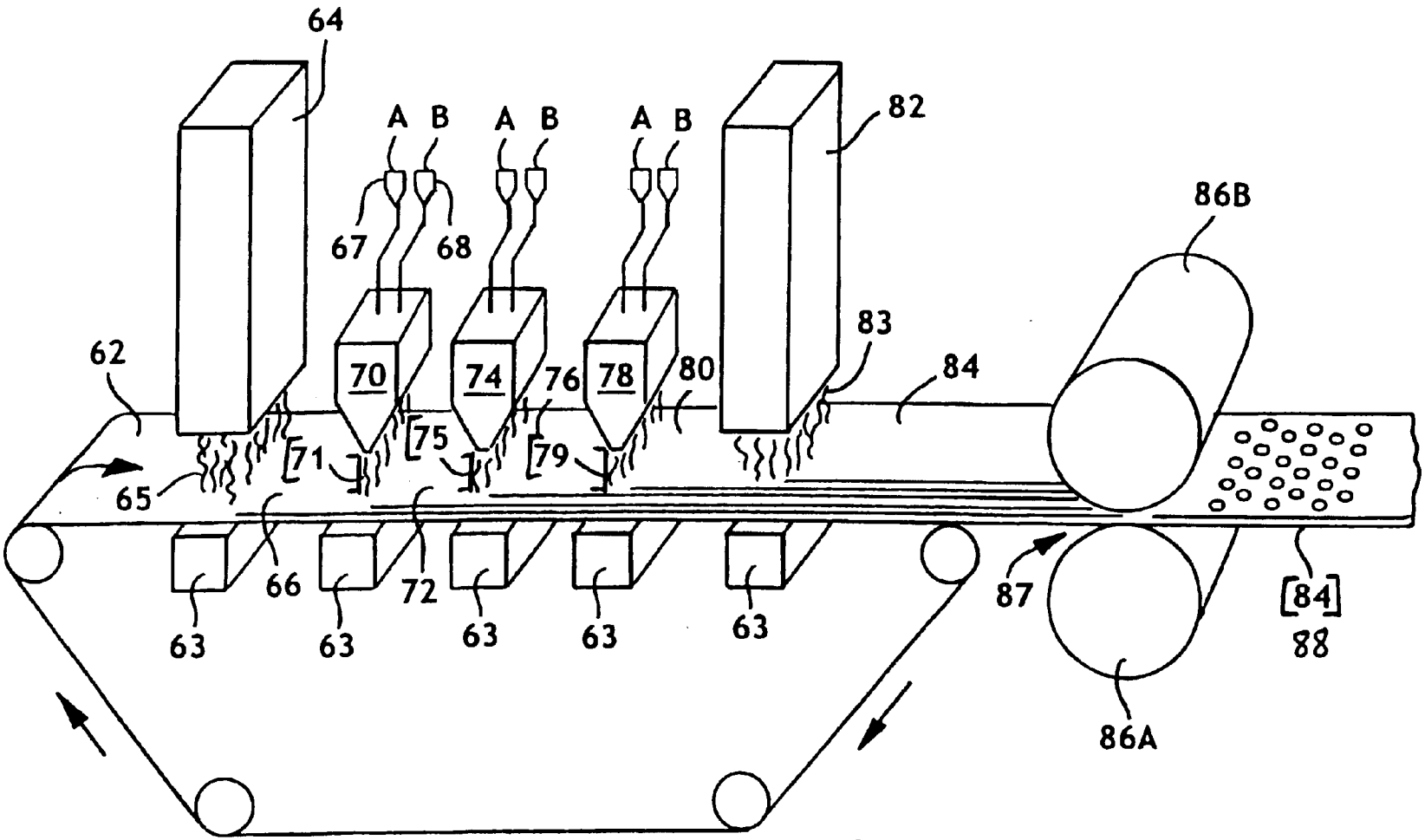
FIG. 7 is a schematic representation of a process line suitable for forming multicomponent meltblown web laminates of the present invention.

Various additional conventional devices may be utilized in conjunction with the system depicted in of FIG. 7 which, for purposes of clarity, have not been illustrated therein. In addition, it will be appreciated by those skilled in the art that the particular process could be varied in numerous respects without departing from the spirit and scope of the invention. As one example, the individual layers of the laminate can be made separately, stored on a roll and subsequently unwound to be converted as desired. When formed in an off-line or separate process, it may often be desirable for handling purposes to form the meltblown upon a carrier sheet such as, for example, a low basis weight spunbond fiber web.

Figure 8:
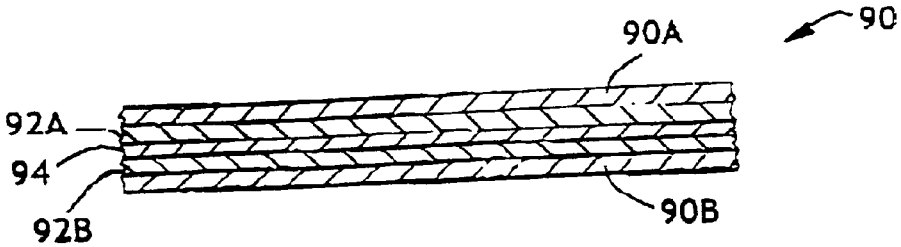
FIG. 8 is a cross-sectional view of a multicomponent meltblown fiber laminate of the present invention.

As indicated above, it is possible to incorporate meltblown fiber layers of varied composition within the laminate structure. For example, a first meltblown layer can comprise a monocomponent meltblown fiber web and the second meltblown fiber web can comprise a multicomponent fiber web. As a particular example, the first meltblown fiber web can comprise a monocomponent meltblown fiber web as described in U.S. Pat. No. 5,188,885 to Timmons et al., the entire contents of which are incorporated herein by reference, and the second layer can comprise a polyethylenelpolypropylene bicomponent meltblown fiber web. Desirably, such a layered composite meltblown fiber web can be positioned between outer layers of polyolefin spunbond fiber webs. As an example and in reference to FIG. 8, a multilayer laminate 90 is shown comprising first and second outer spunbond layers 90A and 90B with first and second multicomponent meltblown fiber layers 92A and 92B disposed therebetween. Positioned between the two multicomponent meltblown fiber layers 92A and 92B is a monocomponent meltblown fiber layer 94. This three layer structure of meltblown fiber webs can also be reversed wherein a multicomponent meltblown fiber web is disposed between two monocomponent meltblown fiber webs. In a further aspect, crimped multicomponent meltblown fiber webs can be utilized in combination with one or more monocomponent meltblown fiber webs to create a filtration gradient. In this regard, the multicomponent meltblown fiber web can have a higher loft and an average pore size greater than that of the monocomponent fiber web. Thus, filter life can be improved since larger particles can be entrapped upstream within the multicomponent meltblown fiber web while finer particles are entrapped downstream within the monocomponent fiber web.

With regard to air filtration materials and various medical fabrics, it will often be advantageous to form an electret from the multicomponent meltblown fiber webs and/or the laminates thereof in order to improve the barrier properties of the fabric. Methods of forming electret articles from polyolefin nonwoven webs are known in the art and, as examples thereof, the webs and laminates of the present invention can be electret treated in a manner as described in U.S. Pat. No. 4,215,682 to Kubic et al., U.S. Pat. No. 4,375,718 to Wadsworth et al. and U.S. Pat. No. 5,401,446 to Tsai et al.

In a further aspect, the multicomponent meltblown fiber webs and/or laminates thereof can be formed into permanent three-dimensional shapes. As used herein, "three-dimensional shape" means a fabric having dimension in the X (length), Y (width) and Z (thickness) directions wherein each dimension of the shaped fabric is greater than the thickness of the fabric itself. As an example, a flat or sheet-like fabric that has been treated to have a permanent cup-like shape is a three-dimensionally shaped fabric when the permanent curvature of the fabric is such that the shaped article has a Z direction greater than the fabric thickness. The three-dimensional shape of the pad may be imparted by one of several methods and as examples the multicomponent meltblown webs or laminates thereof can be molded or thermoformed into the desired shape. Desirably the multicomponent meltblown fiber web or laminate thereof is thermoformed in a manner so as to retain the good hand and softness such as described in U.S. Pat. No. 5,695,376 to Pike et al.; the entire content of the aforesaid references are incorporated herein by reference. The three-dimensionally shaped web or laminate is desirably reversibly-deformable, that is to say that the article has a permanent three-dimensional shape that can be bent or deformed and that will readily return to its original three-dimensional shape upon removing the deforming force. As examples, the multicomponent meltblown fiber webs and/or laminates thereof can comprise the shape of an article such as a feminine pad, a nursing pad, a facemask, and so forth.

The laminates of the present invention can be utilized for or as a component in garments such as, for example, in industrial workwear, undergarments, pants, shirts, jackets, gloves, socks, etc. Further, laminates of the present invention can be employed in infection control products such as surgical gowns and drapes, face masks, head coverings, foot and shoe coverings, wound dressings, bandages, sterilization wraps, wipers, patient bedding and so forth. Still further, laminates of the present invention can be utilized in one or more various aspects as a component within personal care products, e.g. personal hygiene oriented items such as diapers, training pants, absorbent underpants, adult incontinence products, feminine hygiene products, and the like. As specific non-limiting examples thereof, the multicomponent meltblown fiber webs and/or laminates thereof can be used in conjunction with or in a manner as described in the following references: U.S. Pat. No. 4,720,415 to Vander Wielen et al.; U.S. Pat. No. 3,949,128 to Ostermeier, U.S. Pat. No. 5,620,779 to Levy et al.; U.S. Pat. No. 5,714,107 to Levy et al., U.S. Pat. No. 5,759,926 to Pike et al.; U.S. Pat. No. 5,721,180 to Pike et al.; U.S. Pat. No. 5,817,584 to Singer et al.; U.S. Pat. No. 5,639,541 and U.S. Pat. No. 5,811,178 to Adam et al.; U.S. Pat. No. 5,385,775 to Wright et al; U.S. Pat. No. 4,853,281 to Win et al.; EP Application No. 95/938730.9 (Publication No. 0789612); EP Application No. 95/901138.8 (Publication No. 0729375). As further examples, the multicomponent meltblown fiber nonwoven webs can be laminated with one or more films such as, for example, those describe in U.S. Pat. No. 5,695,868 to McCormack; U.S. patent Application Ser. No. 08/724,435 filed Feb. 10, 1998 to McCormack et al,; U.S. patent application Ser. No. 09/122,326 filed Jul. 24, 1998 to Shawver et al.; U.S. Pat. No. 4,777,073 to Sheth; and U.S. Pat. No. 4,867,881 to Kinzer. The aforesaid list of applications of the multicomponent meltblown fiber webs and laminates thereof is not exhaustive and there exist numerous additional uses for the fabrics of the present invention.

In addition, various functional additives and processing aids can be added to one or more components of the multicomponent fibers as desired. As examples, it is common to add thermooxidative stabilizers, UV stabilizers, wetting agents, nucleating agents, pigments and/or other functional additives to fibers. Further, the multicomponent meltblown fibers can be treated with one or more external treatments to improve and/or impart desired characteristics to the fabric. By way of example only, it is common to treat nonwoven fabrics with wetting agents, flame-retardant agents, anti-static agents, odor control agents and so forth. Such treatments can be utilized in connection with the multicomponent meltblown fiber webs and laminates of the present invention as desired.

Tests

Frazier Air Permeability: This test determines the airflow rate through a specimen for a set area size and pressure. The higher the airflow rate per a given area and pressure, the more open the material is, thus allowing more fluid to pass therethrough. The air permeability data reported herein was obtained using a TEXTEST FX 3300 air permeability tester.

Hydrohead: A measure of the liquid barrier properties of a fabric is the hydrohead test. The hydrohead test determines the height of water or amount of water pressure (in millibars) that the fabric will support before liquid passes therethrough. A fabric with a higher hydrohead reading indicates it has a better barrier to liquid penetration than a fabric with a lower hydrohead. The hydrohead data cited herein was obtained in accord with Federal Test Standard 191A, Method 5514 except modified as noted below. The hydrohead was determined using a hydrostatic head tester available from Marl Enterprises, Inc. of Concord, N.C. The specimen is subjected to a standardized water pressure, increased at a constant rate until the first sign of leakage appears on the surface of the fabric in three separate areas. (Leakage at the edge, adjacent to damps is ignored.) Unsupported materials, such as a thin film or nonwoven, are supported to prevent premature rupture of the specimen.

Drape: The drape test measures a fabric's stiffness or resistance to bending. The drape stiffness test determines the bending length of a fabric using the principle of cantilever bending of the fabric under its own weight. The bending length is a measure of the interaction between fabric weight and fabric stiffness. A 1 inch (2.54 cm) by 8 inch (20.3 cm) fabric strip is slid, at 4.75 inches per minute (12 cm/min) in a direction parallel to its long dimension so that its leading edge projects from the edge of a horizontal surface. The length of the overhang is measured when the tip of the specimen is depressed under its own weight to the point where the line joining the Up of the fabric to the edge of the platform makes a 41.5 degree angle with the horizontal. The longer the overhang the slower the specimen was to bend, indicating a stiffer fabric. The drape stiffness is calculated as 0.5×bending length. A total of 5 samples of each fabric should be taken. This procedure conforms to ASTM standard test D-1388 except as noted herein above. The test equipment used is a Cantilever Bending tester model 79-10 available from Testing Machines Inc., 400 Bayview Ave., Amityville, N.Y. 11701.

Tensile Strength: Tensile strength or peak load measures the maximum load (gram force) before the specimen ruptures. A 4 inch by 6 inch sample is placed in a 1 inch by 1 inch rubber coated clamp or jaws and a 1 inch by 2 inch rubber coated clamp or jaws (with the longer dimension being perpendicular to the load) so that the machine direction (i.e. the direction in which the fabric is made) is parallel with the load. The sample is placed in the jaws such that there is a 3 inch gage length. The test can be performed with an 1130 Instron Tensile Tester (available from Instron Corporation of Canton, Mass.) and utilizes a cross-head speed of 12 inches/minute and a 10 pound load cell. The load at rupture is reported in grams. The normalized tensile strength is calculated by dividing the tensile strength by the basis weight (in grams per square meter) and is reported in g per $g/m^2$. Peak strain is the percent elongation at peak load.

Cup Crush: The softness of a nonwoven fabric may be measured according to the "cup crush" test. The cup crush test evaluates fabric stiffness by measuring the peak load or "cup crush" required for a 4.5 cm diameter hemispherically shaped foot to crush a 25 cm by 25 cm piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. An average of 10 readings is used. The foot and the cup are aligned to avoid contact between the cup walls and the foot which could affect the readings. The peak load is measured while the foot is descending at a rate of 40.6 cm/minute and is measured in grams. The cup crush test also yields a value for the total energy required to crush a sample (the "cup crush energy") which is the energy from the start of the test to the peak load point, i.e. the area under the curve formed by the load in grams on one axis and the distance the foot travels in millimeters on the other. Cup crush energy is therefore reported in g-mm. Lower cup crush values indicate a softer laminate. A suitable device for measuring cup crush is a Sintech Tensile Tester and 500 g load cell using TESTWORKS Software all of which are available from Sintech, Inc. of Research Triangle Park, N.C.

EXAMPLES

Example 1

First and second polymers were melted and the respective molten polymer streams were separately directed through the die apparatus until just prior to the die capillary entrance. The first polymer comprised linear low density polyethylene (DOW 6831A LLDPE) and the second polymer comprised conventional polypropylene (Montell PF015). The meltblown was formed using hot primary air having a temperature of about 226° C. The resulting bicomponent meltblown had a side-by-side cross-sectional configuration and the first and second components each comprised about 50%, by volume, of the fiber. The 0.5 ounce/square yard (17 $g/m^2$) meltblown fabric had an supported hydrohead of 70 mbar and an air permeability of 69 cubic feet/minute/square foot.

Example 2

First and second polymers were melted and the respective molten polymer streams were separately directed through the die apparatus until just prior to the die capillary entrance. The first polymer comprised linear low density polyethylene (DOW 6831A LLDPE) and the second polymer comprised an amorphous polypropylene homopolymer (Huntsman 121 FPO). The meltblown was formed using cold primary air having a temperature of about 27° C. The resulting bicomponent meltblown had a side-by-side cross-sectional configuration and the first and second components each comprised about 50%, by volume, of the fiber. The 0.5 ounce/square yard (17 $g/m^2$) meltblown fabric had a supported hydrohead of 52 mbar and a Frazier air permeability of 125 cubic feet/minute/square foot.

Example 3

First and second polymers were melted and the respective molten polymer streams were separately directed through the die apparatus until just prior to the die capillary entrance. The first polymer comprised linear low-density polyethylene (DOW 6831A LLDPE) and the second polymer comprised an amorphous polypropylene homopolymer (Huntsman 121 FPO). The meltblown was formed using hot primary air having a temperature of about 226° C. The resulting bicomponent meltblown had a side-by-side cross-sectional configuration and the first and second components each comprised about 50%, by volume, of the fiber. The 0.5 ounce/square yard (17 $g/m^2$) meltblown fabric had a supported hydrohead of 51 mbar and an air permeability of 92 cubic feet/minute/square foot.

Example 4

First and second polymers were melted and the respective molten polymer streams were separately directed through the die apparatus until just prior to the die capillary entrance. The first polymer comprised an amorphous propylene polymer (Huntsman 120 FPO) and the second polymer comprised crystalline polypropylene (Exxon 3505 polypropylene). The resulting bicomponent meltblown had a side-by-side cross-sectional configuration and the first and second components each comprised about 50%, by volume, of the fiber. The 0.6 ounce/square yard (20 $g/m^2$) meltblown fabric had a peak load of 1.74 pounds (0.79 kg) and a peak stain of abut 56% in the machine direction and a peak load of 1.04 pounds (0.47 kg) and a peak strain of about 83% in the cross-direction.

Example 5

First and second polymers were melted and the respective molten polymer streams were separately directed through the die apparatus until just prior to the die capillary entrance. The first polymer comprised linear low density polyethylene (DOW 6831A LLDPE) and the second polymer comprised conventional polypropylene (Motnell PF015 polypropylene). The resulting 17 $g/m^2$ bicomponent meltblown fabric had a side-by-side cross-sectional configuration and the first and second components each comprised about 50%, by volume, of the fiber. The meltblown fabric was juxtaposed between two nonwoven webs of bicomponent spunbond fibers. The bicomponent spunbond fibers comprised 50/50 polyethylene/polypropylene sheath/core fibers and had a basis weight of 17 $g/m^2$ each. The three layers were thermally point bonded using a pattern which bonds approximately 18% of the surface area of the fabric.

The SMS laminate had a supported hydrohead of 66 mbar, an air permeability of 70 cubic feet/minute/square foot, a cup crush energy of 2032 g-mm and an average drape of 1.74 cm in the cross-direction and 3.22 in the machine direction.

We claim:

1. A nonwoven laminate comprising:

a first layer having a first side and a second side, said first layer comprising a nonwoven web of multicomponent meltblown fibers having a first polymeric component and a second polymeric component in distinct zones across the cross-section of the fibers which extend substantially continuously along the length of the fibers, said multicomponent multiblown fibers having an average fiber diameter less than about 7 micrometers;

a second layer proximate the first side of said fist layer, said second layer comprising a nonwoven web of continuous bicomponent spunbond fibers having an average fiber diameter greater than about 10 micrometers;

a third layer proximate the second side of said first layer, said third layer comprising a nonwoven web of continuous bicomponent spunbond fibers having an average fiber diameter greater than about 10 micrometers; and wherein the first polymeric component of said multicomponent meltblown fiber web comprises a propylene polymer having a crystallinity above 70 J/g and further wherein the second polymeric component of said meltblown fiber web comprises an amorphous polyalphaolefins having a crystallinity below about 65 J/g and wherein said layers are bonded together to form a multilayer laminate.

2. A nonwoven laminate comprising:

a first layer having a first side and a second side, said first layer comprising a nonwoven web of multicomponent meltblown fibers having a first polymeric component and a second polymeric component in distinct zones across the cross-section of the fibers which extend substantially continuously along the length of the fibers, said multicomponent meltblown fibers having an average fiber diameter less than about 7 micrometers;

a second layer proximate the first side of said first layer, said second layer comprising a nonwoven web of continuous bicomponent spunbond fibers having an average fiber diameter greater than about 10 micrometers, a third layer proximate the second side of said first layer, said third layer comprising a nonwoven web of continuous bicomponent spunbond fibers having an average fiber diameter greater tan about 10 micrometers; and wherein said second and third spunbond layers are extensible and further wherein the first polymeric component of said multicomponent meltblown fiber web comprises an elastic polyolefin and wherein said second component of the multicomponent meltblown fiber web comprises an elastic polymer and wherein said layers are bonded together to form a multilayer laminate.

3. The nonwoven laminate of claim 2 wherein second component of the multicomponent meltblown War web comprises an elastic polyolefin.

4. The nonwoven laminate of claim 2 wherein the second component of the multicomponent meltblown fiber web comprises a blend of a polyolefin and a non-olefin thermoplastic elastomer.

5. The nonwoven laminate of claim 2 wherein the second component of the multicomponent meltblown fiber web comprises an elastic non-olefin thermoplastic elastomer.

6. The nonwoven laminate of claim 2 wherein the second component of the multicomponent meltblown fiber web comprises a block copolymer having a styrenic moiety end block and an elastomeric mid-block.

7. A nonwoven laminate comprising:

a first layer having a first side and a second side, said first layer comprising a nonwoven web of multicomponent meltblown fibers having a first polymeric component and a second polymeric component In distinct zones across the cross-section of the fibers which extend substantially continuously along the length of the fibers, said multicomponent meltblown fibers having an average fiber diameter less than about 7 micrometers, said first layer further comprising a nonwoven web of monocomponent polypropylene meltblown fibers;

a second layer proximate the first side of said first layer, said second layer comprising a nonwoven web of continuous bicomponent spunbond fibers having an average fiber diameter greater than about 10 micrometers;

a third layer proximate the second side of said first layer, said third layer comprising a nonwoven web of continuous bicomponent spunbond fibers having an average fiber diameter greater than about 10 micrometers; and wherein said layers are bonded together to form a multilayer laminate.

8. The nonwoven laminate of claim 7 wherein the first polymeric component comprises a crystalline propylene polymer and wherein the second polymeric component comprises an amorphous propylene polymer.

* * * * *